US007886851B2

(12) United States Patent
Hall et al.

(10) Patent No.: US 7,886,851 B2
(45) Date of Patent: Feb. 15, 2011

(54) DRILL BIT NOZZLE

(75) Inventors: David R. Hall, Provo, UT (US); John D. Bailey, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 248 days.

(21) Appl. No.: 11/871,480

(22) Filed: Oct. 12, 2007

(65) Prior Publication Data

US 2008/0035388 A1 Feb. 14, 2008

Related U.S. Application Data

(63) Continuation-in-part of application No. 11/861,641, filed on Sep. 26, 2007, which is a continuation-in-part of application No. 11/766,975, filed on Jun. 22, 2007, application No. 11/871,480, which is a continuation-in-part of application No. 11/774,227, filed on Jul. 6, 2007, now Pat. No. 7,669,938, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation-in-part of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 11/871,480, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21B 10/42* (2006.01)

(52) U.S. Cl. ..... 175/400

(58) Field of Classification Search ..... 175/398, 175/400, 429

See application file for complete search history.

(56) References Cited

U.S. PATENT DOCUMENTS 1,879,177 A 9/1932 Gault (Continued)

OTHER PUBLICATIONS

SME Mining Engineerign Handbook, 1992, pp. 691 and 692.*

(Continued)

*Primary Examiner*—John Kreck
(74) *Attorney, Agent, or Firm*—Holme Roberts & Owen LLP

(57) ABSTRACT

A drill bit comprising a body intermediate a threaded shank and a working face with the working face comprising a plurality of blades converging towards a center of the working face and diverging towards a gauge of the working face. Junk slots comprising a base are formed by the plurality of blades. At least one blade comprising at least one culling surface with a carbide substrate is bonded to a diamond working end. At least one high pressure nozzle is disposed between at least two blades and within a nozzle bore formed into an elevated surface extending from the base of the junk slots. The elevated surface is disposed adjacent the diamond working end of the least one blade.

20 Claims, 10 Drawing Sheets

U.S. PATENT DOCUMENTS 2,064,255 A 12/1936 Garfield
2,776,819 A 1/1957 Brown
2,819,043 A 1/1958 Henderson
2,838,284 A 6/1958 Austin
2,894,722 A 7/1959 Buttolph
2,963,102 A 12/1960 Smith
3,135,341 A 6/1964 Ritter
3,294,186 A 12/1966 Buell
3,301,339 A 1/1967 Pennebaker, Jr.
3,429,390 A 2/1969 Bennett
3,583,504 A 6/1971 Aalund
3,765,493 A 10/1973 Rosar et al.
3,821,993 A 7/1974 Kniff et al.
3,955,635 A 5/1976 Skidmore
4,096,917 A 6/1978 Harris
4,098,363 A * 7/1978 Rohde et al. ..... 175/391
4,176,723 A 12/1979 Arceneaux
4,253,533 A 3/1981 Baker, III
4,280,573 A 7/1981 Sudnishnikov et al.
4,304,312 A 12/1981 Larsson
4,397,361 A 8/1983 Langford
4,445,580 A 5/1984 Sahley
4,448,269 A 5/1984 Ishikawa et al.
4,499,795 A 2/1985 Radtke
4,535,853 A 8/1985 Ippolito et al.
4,538,691 A 9/1985 Dennis
4,550,790 A * 11/1985 Link ..... 175/393
4,574,895 A 3/1986 Dolezal et al.
4,640,374 A 2/1987 Dennis
4,852,672 A 8/1989 Behrens
4,889,017 A 12/1989 Fuller et al.
4,962,822 A 10/1990 Pascale
4,981,184 A 1/1991 Knowlton et al.
5,027,914 A 7/1991 Wilson
5,119,892 A 6/1992 Clegg et al.
5,141,063 A 8/1992 Quesenbury
5,186,268 A 2/1993 Clegg
5,222,566 A 6/1993 Taylor et al.
5,255,749 A 10/1993 Bumpurs et al.
5,265,682 A 11/1993 Russell et al.
5,361,859 A 11/1994 Tibbitts
5,410,303 A 4/1995 Comeau et al.
5,417,292 A 5/1995 Polakoff
5,423,389 A 6/1995 Warren et al.
5,560,440 A 10/1996 Tibbitts
5,655,614 A 8/1997 Azar
5,678,644 A 10/1997 Fielder
5,732,784 A 3/1998 Nelson
5,794,728 A 8/1998 Palmberg
5,947,215 A 9/1999 Lundell
5,950,743 A 9/1999 Cox
5,957,223 A 9/1999 Doster et al.
5,957,225 A 9/1999 Sinor
5,967,247 A 10/1999 Pessier
5,979,571 A 11/1999 Scott et al.
5,992,547 A 11/1999 Caraway et al.
5,992,548 A 11/1999 Silvia et al.
6,021,859 A 2/2000 Tibbitts et al.
6,039,131 A 3/2000 Beaton
6,131,675 A 10/2000 Anderson
6,145,608 A * 11/2000 Lund et al. ..... 175/428
6,150,822 A 11/2000 Hong et al.
6,186,251 B1 2/2001 Butcher
6,213,226 B1 4/2001 Eppink et al.
6,223,824 B1 5/2001 Moyes
6,253,864 B1 7/2001 Hall
6,269,893 B1 8/2001 Beaton et al.
6,296,069 B1 10/2001 Lamine et al.
6,340,064 B2 1/2002 Fielder et al.
6,364,034 B1 4/2002 Schoeffler
6,394,200 B1 5/2002 Watson et al.
6,474,425 B1 11/2002 Truax et al.
6,484,825 B2 11/2002 Watson et al.
6,510,906 B1 1/2003 Richert et al.
6,513,606 B1 2/2003 Krueger
6,594,881 B2 7/2003 Tibbitts
6,601,454 B1 8/2003 Botnan
6,622,803 B2 9/2003 Harvey et al.
6,729,420 B2 5/2004 Mensa-Wilmot
6,822,579 B2 11/2004 Goswami et al.
6,953,096 B2 10/2005 Gledhill et al.
7,104,344 B2 9/2006 Kriesels et al.
7,207,398 B2 4/2007 Runia et al.
7,395,882 B2 * 7/2008 Oldham et al. ..... 175/402
2006/0076163 A1 * 4/2006 Terracina et al. ..... 175/393

OTHER PUBLICATIONS

Durrand, et al., Christoper J., Super-hard, Thick, Shaped PDC Cutters for Hard Rock Drilling: Development and Test Results, pp. 1-8, Feb. 3, 2010, Geothermal Reservoir Engineering, Stanford, CA.

Glowka et al., David A., Progress in the Advanced Synthetic-Diamond Drill Bit Program, 1995, pp. 1-9.

Hoch, G. Jeffrey, Is There Room for Geothermal Energy, Innovation: America's Journal of Technology Communication, Dec. 2006/Jan. 2007, pp. 1-3, web print at http://www.innovation-america.org/archive.php?articleID=215.

Jennejohn, Dan, Research and Development in Geothermal Exploration and Drilling, Dec. 2009, pp. 5, 18-19, Geothermal Energy Association, Washington, D.C.

Taylor, Mark A., The State of Geothermal Technology, Part 1: Subsurface Technology, Nov. 2007, pp. 29-30, Geothermal Energy Association for the US Department of Energy, Washington, DC.

US Department of Energy, Geothermal Drilling, Faster and Cheaper is Better, Geothermal Today, May 2000, p. 28, National Technology Information Service, Springfield, VA.

* cited by examiner

DRILL BIT NOZZLE

RELATED APPLICATIONS

This application is a continuation-in-part of U.S. patent application Ser. No. 11/861,641 filed on Sep. 26, 2007. U.S. patent application Ser. No. 11/861,641 is a continuation-in-part of U.S. patent application Ser. No. 11/766,975 filed on Jun. 22, 2007. This application is also a continuation-in-part of U.S. patent application Ser. No. 11/774,227 filed on Jul. 6, 2007 and is now U.S. Pat. No. 7,669,938 that issued on Mar. 2, 2010. U.S. patent application Ser. No. 11/774,227 is a continuation-in-part of U.S. patent application Ser. No. 11/773,271 filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007 and is now U.S. Pat. No. 7,475,948 that issued on Jan. 13, 2009. U.S. patent application Ser. No. 11/742,304 is a continuation of U.S. patent application Ser. No. 11/742,261 filed on Apr. 30, 2007 and is now U.S. Pat. No. 7,469,971 that issued on Dec. 30, 2008. U.S. patent application Ser. No. 11/742,261 is a continuation-in-part of U.S. patent application Ser. No. 11/464,008 filed on Aug. 11, 2006 and is now U.S. Pat. No. 7,338,135 that issued on Mar. 4, 2008. U.S. patent application Ser. No. 11/464,008 is a continuation-in-part of U.S. patent application Ser. No. 11/463,998 filed on Aug. 11, 2006 and is now U.S. Pat. No. 7,384,105 that issued on Jun. 10, 2008. U.S. patent application Ser. No. 11/463,998 is a continuation-in-part of U.S. patent application Ser. No. 11/463,990 filed on Aug. 11, 2006 and is now U.S. Pat. No. 7,320,505 that issued on Jan. 22, 2008. U.S. patent application Ser. No. 11/463,990 is a continuation-in-part of U.S. patent application Ser. No. 11/463,975 filed on Aug. 11, 2006 and is now U.S. Pat. No. 7,445,294 that issued on Nov. 4, 2008. U.S. patent application Ser. No. 11/463,975 is a continuation-in-part of U.S. patent application Ser. No. 11/463,962 filed on Aug. 11, 2006 and is now U.S. Pat. No. 7,413,256 that issued on Aug. 19, 2008. U.S. patent application Ser. No. 11/463,962 is a continuation-in-part of U.S. patent application Ser. No. 11/463,953 also filed on Aug. 11, 2006 and is now U.S. Pat. No. 7,464,993 that issued on Dec. 16, 2008. The present application is also a continuation-in-part of U.S. patent application Ser. No. 11/695,672 filed on Apr. 3, 2007 and is now U.S. Pat. No. 7,396,086 that issued on Jul. 8, 2008. U.S. patent application Ser. No. 11/695,672 is a continuation-in-part of U.S. patent application Ser. No. 11/686,831 filed on Mar. 15, 2007 and is now U.S. Pat. No. 7,568,770 that issued on Aug. 4, 2009. All of these applications are herein incorporated by reference for all that they contain.

BACKGROUND OF THE INVENTION

This invention relates to drill bits, specifically drill bit assemblies for use in oil, gas and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit balling in soft formations and bit whirl in hard formations may reduce penetration rates and may result in damage to the drill bit.

U.S. Pat. No. 4,098,363 by Rhode et al., which is herein incorporated by reference for all that it contains, discloses a drill bit employing spaced shaped cutters in arrays separated by fluid channels in which there are positioned arrays of nozzles suitable for bit cleaning and detritus removal action.

U.S. Pat. No. 5,361,859 by Tibbitts, which is herein incorporated by reference for all that it contains, discloses a drill bit for use with earth drilling equipment, the drill bit having a body and movable cutting members variably positioned between a first position in which the diameter defined by the cutting members is generally equal to or less than the diameter of the drill bit body and a second position in which the diameter defined by the cutting members is greater than the diameter of the drill bit body.

U.S. Pat. No. 5,794,725 by Trujillo et al., which is herein incorporated by reference for all that it contains, discloses a drilling structure having a body defining at least one primary channel and at least one secondary channel therein to initiate and maintain recirculation of an amount of drilling fluid back through the secondary channel to maintain positive independent flow of drilling fluid through each primary channel of the drilling structure.

U.S. Pat. No. 6,253,864 by Hall, which is herein incorporated by reference for all that it contains, discloses a drill bit that combines the forces of high rotational torque and percussive impact with impact-resistant shear cutting inserts in order to increase formation penetration rates, particularly in deep wells were borehole pressure is high. The drill bit may also be used in cooperation with high-pressure nozzles that augment penetration, cool the shear cutting inserts, and remove the chips.

BRIEF SUMMARY OF TILE INVENTION

A drill bit comprises a body intermediate a threaded shank and a working face with the working face comprising a plurality of blades converging towards a center of the working face and diverging towards a gauge of the working face. Junk slots comprising a base are formed by the plurality of blades. At least one blade comprising at least one cutting surface with a carbide substrate is bonded to a diamond working end. At least one high pressure nozzle is disposed between at least two blades in a nozzle bore formed in an elevated surface from the base of the junk slots. The elevated surface is disposed adjacent the diamond working end of the least one blade.

At least one of the two blades may comprise cutting surfaces with planar cutting surfaces and the other of the at least two blades may comprise cutting surfaces with pointed cutting surfaces. The diamond working end may comprise a planar cutting surface or a pointed cutting surface. The pointed diamond working ends may be positioned within the blade at a 25 to 65 positive rake angle. The at least one high-pressure nozzle may comprise a diameter of 0.2125-0.4125 inches and may be positioned within a nozzle bore less than 1 inch beneath the elevated surface. The at least one high-pressure nozzle may also be angled such that fluid is directed toward the at least one cutting surface. The nozzle may also comprise diamond that may aid in resistance to wear that may occur to the nozzle.

The base of the junk slots may comprise a plurality of high pressure base nozzles. The high-pressure base nozzles disposed at the base of the junk slot may be disposed in front of the diamond working end with a pointed cutting surface. The junk slots formed by the plurality of blades may comprise a plurality of elevated surfaces. The elevated surface may comprise a plurality of high-pressure nozzles disposed on different elevated levels within the elevated surface in front of the diamond working end with a planar cutting surface. The elevated surface may extend to the diamond working end and comprise a geometry complimentary to the blade comprising the at least one cutting surface. The at least one high-pressure nozzle may be fixed within the elevated surface by being brazed into the elevated surface. The diameter of the at least one high-pressure nozzle may be smaller than the diameter of the nozzle disposed in the base of the junk slot. The elevated surface may extend from a nose of the blade to a conical region of the blade. The elevated surface may be a step formed in the blade. The elevated surface may also be in contact with a side of the blade opposite the side comprising the diamond working end, and in contact with the base of the junk slot. The elevated surface may further comprise a single side in contact with a blade.

DETAILED DESCRIPTION OF EXEMPLARY EMBODIMENTS

Figure 1:
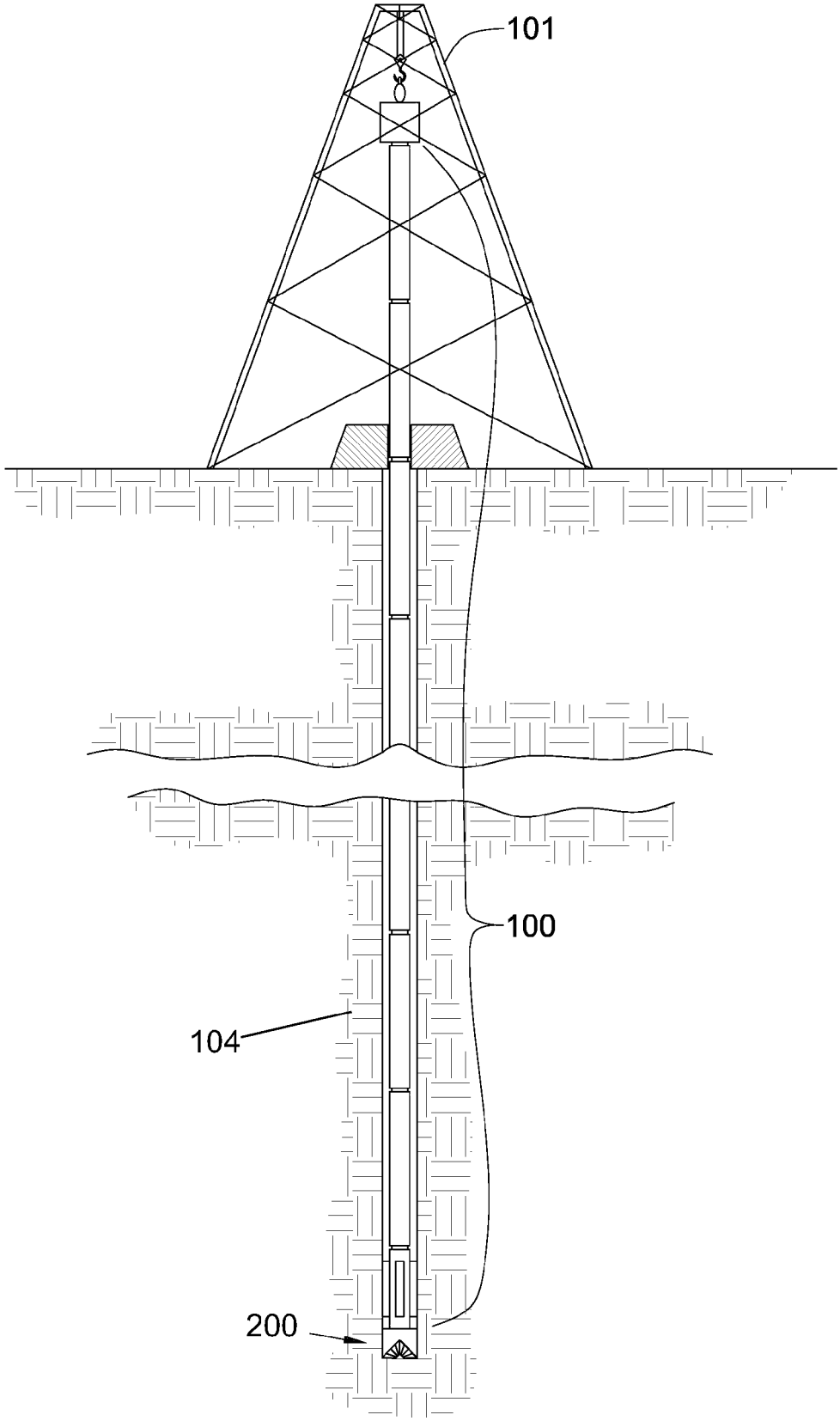
FIG. 1 is an orthogonal diagram of an embodiment of a tool string.

FIG. 1 is an orthogonal diagram of a derrick 101 attached to a tool string 100 comprising a drill bit 200 located at the bottom of a bore hole. The tool string 100 may be made of rigid drill pipe, drill collars, heavy weight pipe, jars, and/or subs. As the drill bit 200 rotates downhole the tool string 100 advances farther into the formation 104 due to the weight on the drill bit 200 and a cutting action of the drill bit 200.

Figure 2:
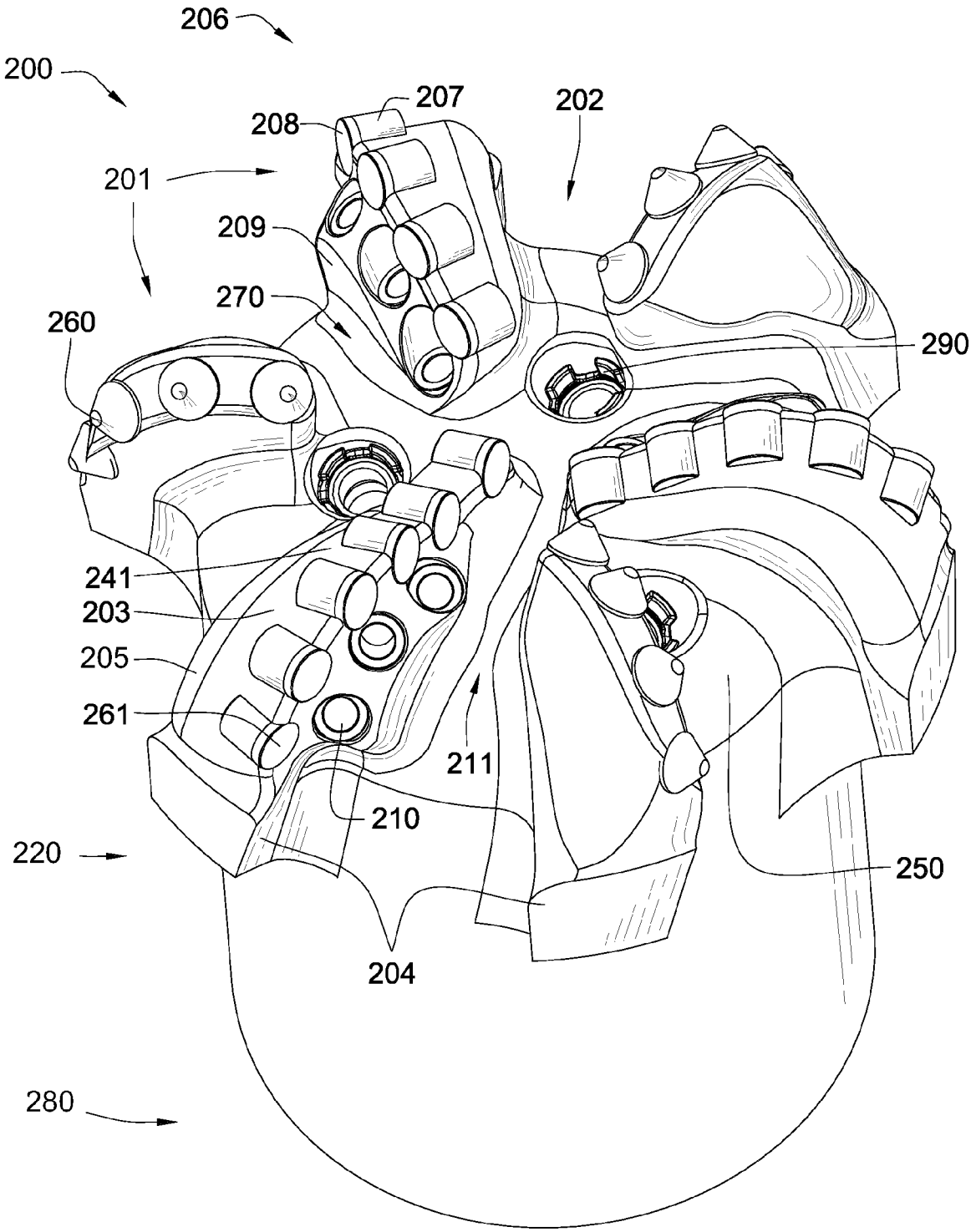
FIG. 2 is a top perspective diagram of an embodiment of a drill bit.

FIG. 2 is a top perspective diagram of the exemplary drill bit 200 (FIG. 1). The drill bit 200 may comprise a body 220 intermediate a shank 280 and a working face 202. The drill bit 200 may comprise a plurality of blades 201. The blades 201 may be disposed on the working face 202 of the drill bit 200. The plurality of blades 201 may converge towards a center of the working face 202 and diverge towards a gauge 204 of the working face 202 creating junk slots 250 intermediate the blades 201. The blades 201 may comprise a nose 203 portion intermediate or between the gauge 204 and a conical region 241. The blades 201 may also comprise a flank 205 intermediate or between the gauge 204 and the nose 203 portion.

At least one blade 201 may comprise at least one culling or cutting surface 206 with a carbide substrate 207 bonded to a diamond working end 208. The diamond working end 208 may comprise a pointed cutting surface 260 or a planar cutting surface 261. The cutting surface 206 may be used in drilling for oil and gas applications. During drilling often times debris can build up within the junk slots 250 and impede the efficiency of the drill bit 200. Immediately adjacent to the diamond working end 208 may be at least one high-pressure nozzle 210 adapted to remove debris from the drill bit 200. The nozzle 210 nearest the flank 205 may be directed such that the fluid is directed away from the diamond working end 208.

The at least one high-pressure nozzle 210 may be disposed in an elevated surface 209 within the junk slots 250. The elevated surface 209 may extend to the diamond working end 208. The elevated surface 209 may comprise a bottom 270 that is opposite the diamond working end 208 and is in contact with the base 211 of the junk slot 250. The elevated surface 209 may also comprise a single side that is in contact with a blade 201. The inner diameter of the at least one nozzle 210 may be 0.2125-0.4125 inches. FIG. 2 shows the at least one high-pressure nozzle 210 in the elevated surface 209 in front of the blades 201 that comprise a diamond working end 208 with a planar cutting surface 261. FIG. 2 also shows base nozzles 290 disposed at the base 211 of the junk slots 250 in front of the blades 201 that comprise a diamond working end 208 with a pointed cutting surface 260.

The shank 280 comprises a plurality of threads which allow for attachment of the drill bit 200 to a tool string component (not shown). The threads allow the component and the drill bit to be rigidly fixed to one another while at the same time allowing torque in the tool string component to be transferred to the drill bit. This is in contrast to traditional air-hammer bits which allow the shank of the bit to slide with respect to the adjacent tool string component to effect a hammering action.

In some embodiments the working face 202 of the drill bit 200 may not comprise flat surfaces. For instance, the elevated surface 209 may also comprise recesses to create a continuously rounded surface which may also accommodate the flow of the cut material.

Figure 3:
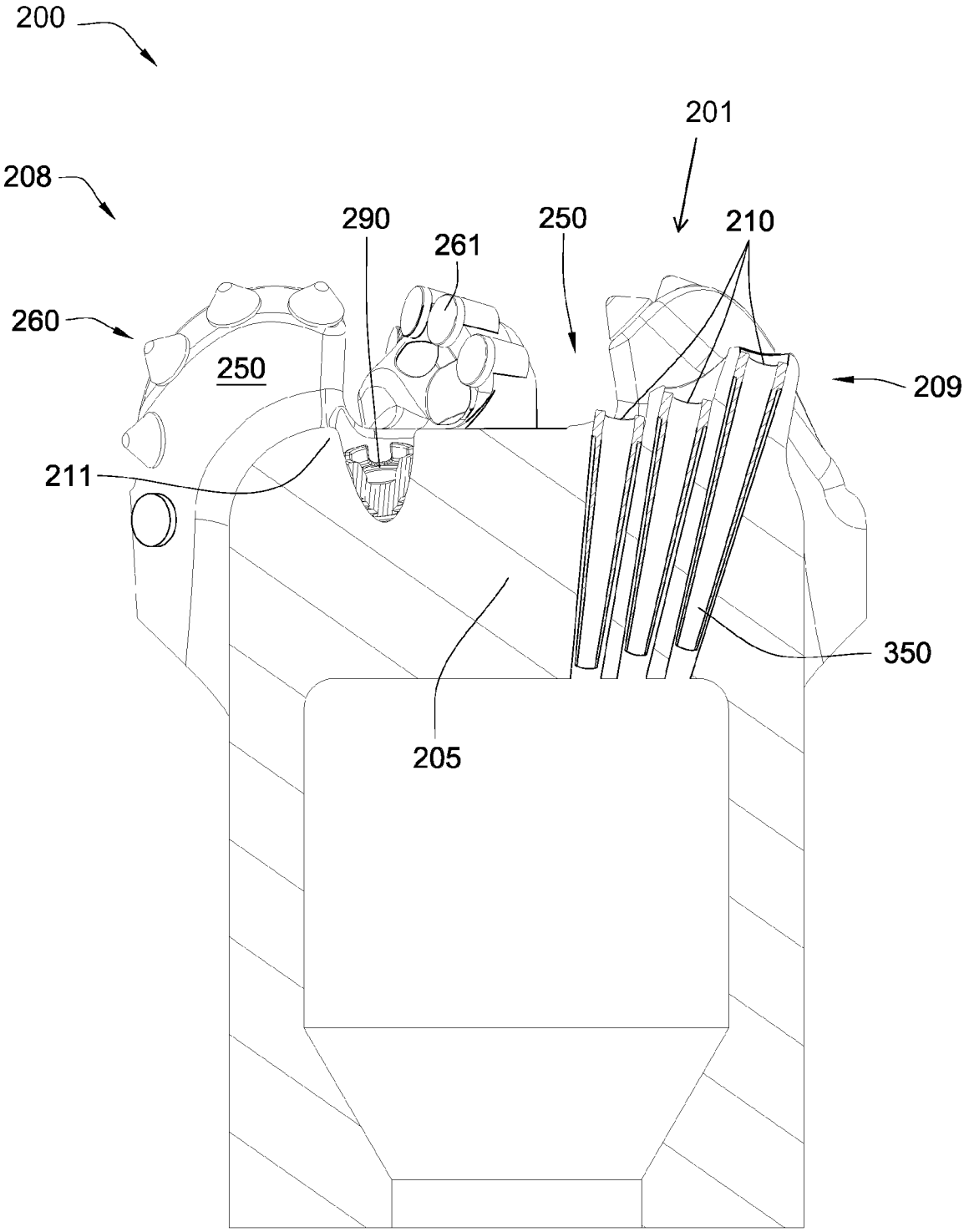
FIG. 3 is a cross-sectional diagram of an embodiment of a drill bit.

FIG. 3 is a cross-sectional diagram of the exemplary drill bit 200. The at least one nozzle 210 may comprise a length larger than the length of the base nozzles 290 disposed in the base 211 of the junk slots 250, and may be comprise carbide, diamond, or a combination thereof. The at least one nozzle 210 may be adjacent to the axis of the drill bit 200. The at least one nozzle 210 may be fixed to the elevated surface 209 extending from the junk slot 250. The base nozzle 290 disposed in the base 211 of the junk slot 250 maybe threaded such that they are adjustable. The at least one nozzle 210 may also comprise a taper 350 near the end opposite the end adjacent to the diamond working end 208. FIG. 3 shows a plurality of blades 201 that may comprise a diamond working end 208 with a pointed cutting surface 260 or a planar culling surface 261 with every other blade comprising a different cutting surface.

Figure 4:
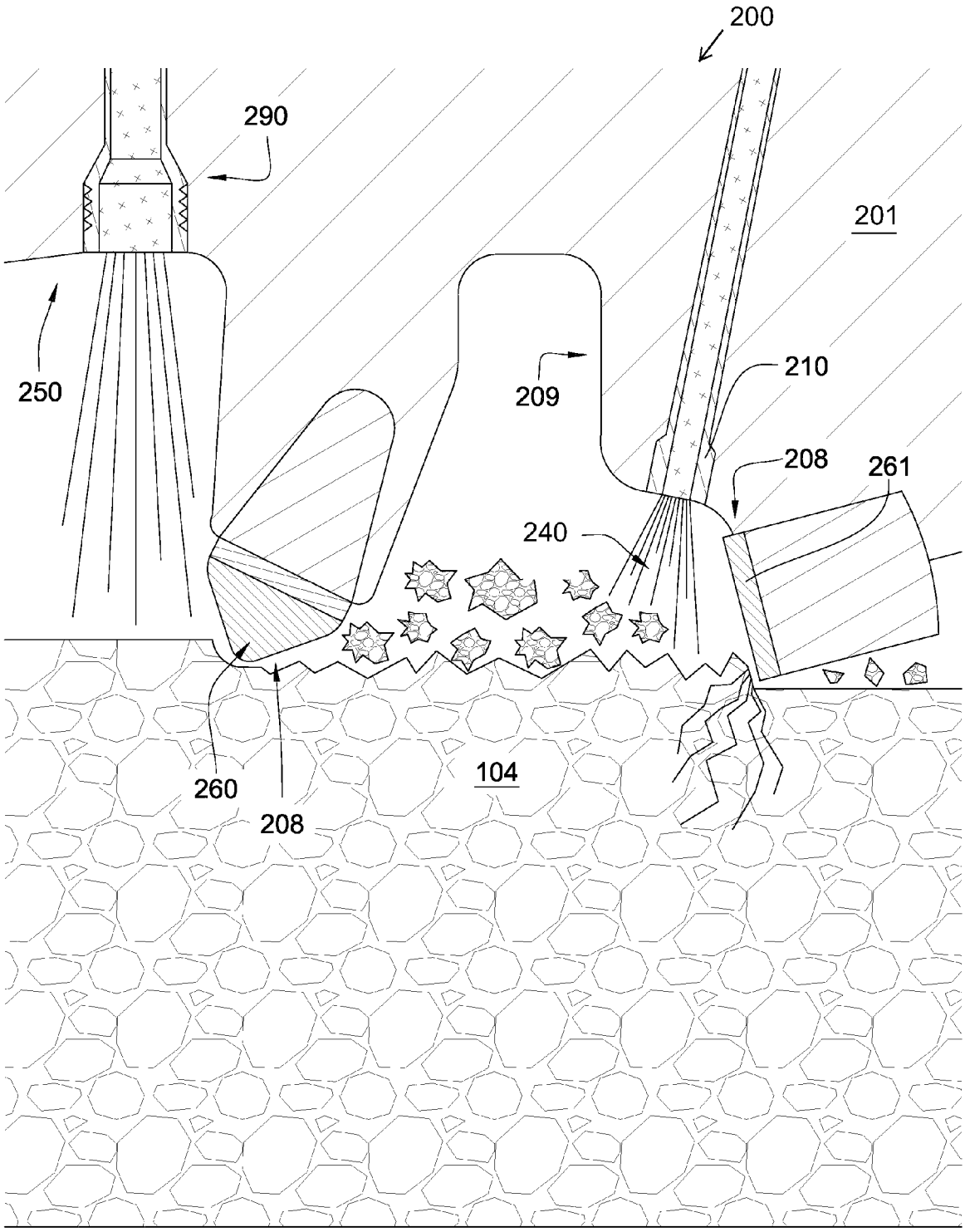
FIG. 4 is a cross-sectional diagram of another embodiment of a drill bit.

FIG. 4 is a cross-sectional diagram of the exemplary drill bit 200 engaging a formation 104. The diamond working end 208 with a pointed cutting surface 260 may extend further into the formation 104 than the diamond working end 208 with a planar cutting surface 261. Moreover, the diamond working end 208 with the pointed cutting surface 260 may be secured to the blade at a 25 to 65 positive rake angle. In one exemplary embodiment the drill bit 200 can include at least two blades having cutting surfaces with planar cutting surfaces and at least two blades having cutting surfaces with pointed cutting surfaces.

The diamond working end 208 with the pointed cutting surface 260 may first crush the formation 104 and then the diamond working end 208 with a planar cutting surface 261 may shear formation that is left. Immediately in front of the blade 201 comprising the diamond working end 208 with a planar cutting surface 261 may be at least one nozzle 210 within an elevated surface 209. In the base 211 of the junk slot 250 and in front of the diamond working end 208 with a pointed cutting surface 260 may be a base nozzle 290 adapted to project fluid. The diamond working ends 208 may contact the formation 104, such as shown in FIG. 4, and loosen the formation 104. As the formation 104 loosens the at least one nozzle 210 may project fluid 400 toward the formation 104. The fluid may aid in preventing the loosened formation 104 from obstructing the drill bit 200.

Figure 5:
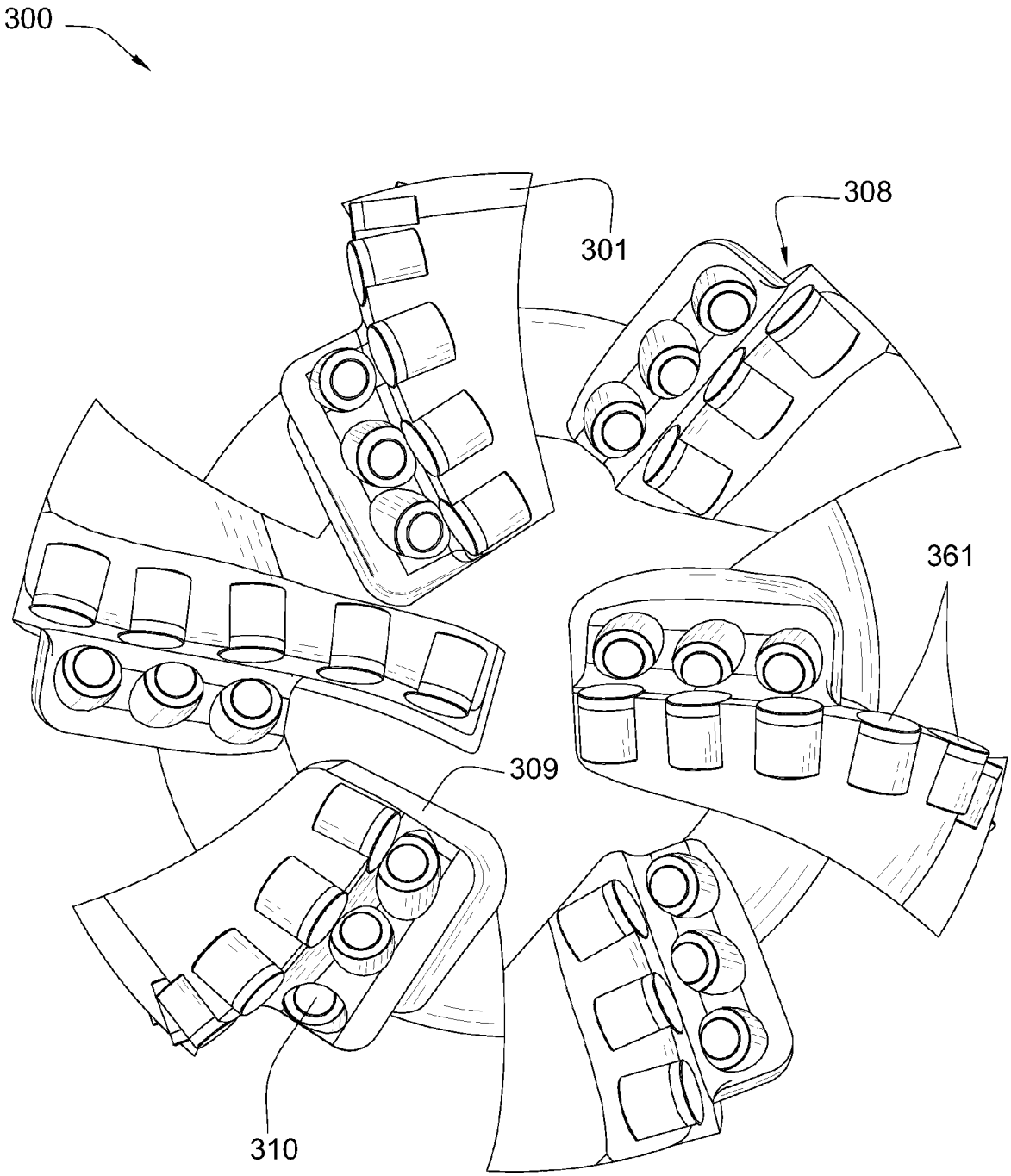
FIG. 5 is a perspective diagram of another embodiment of a drill bit.

FIG. 5 is a perspective diagram of a drill bit 300. FIG. 5 shows a plurality of blades 301 comprising a plurality of diamond working ends 308, the plurality of diamond working ends 308 may comprise planar cutting surfaces 361. Immediately in front of the plurality of blades 301 comprising diamond working ends 308 may be an elevated surface 309 comprising at least one nozzle 310.

Figure 6:
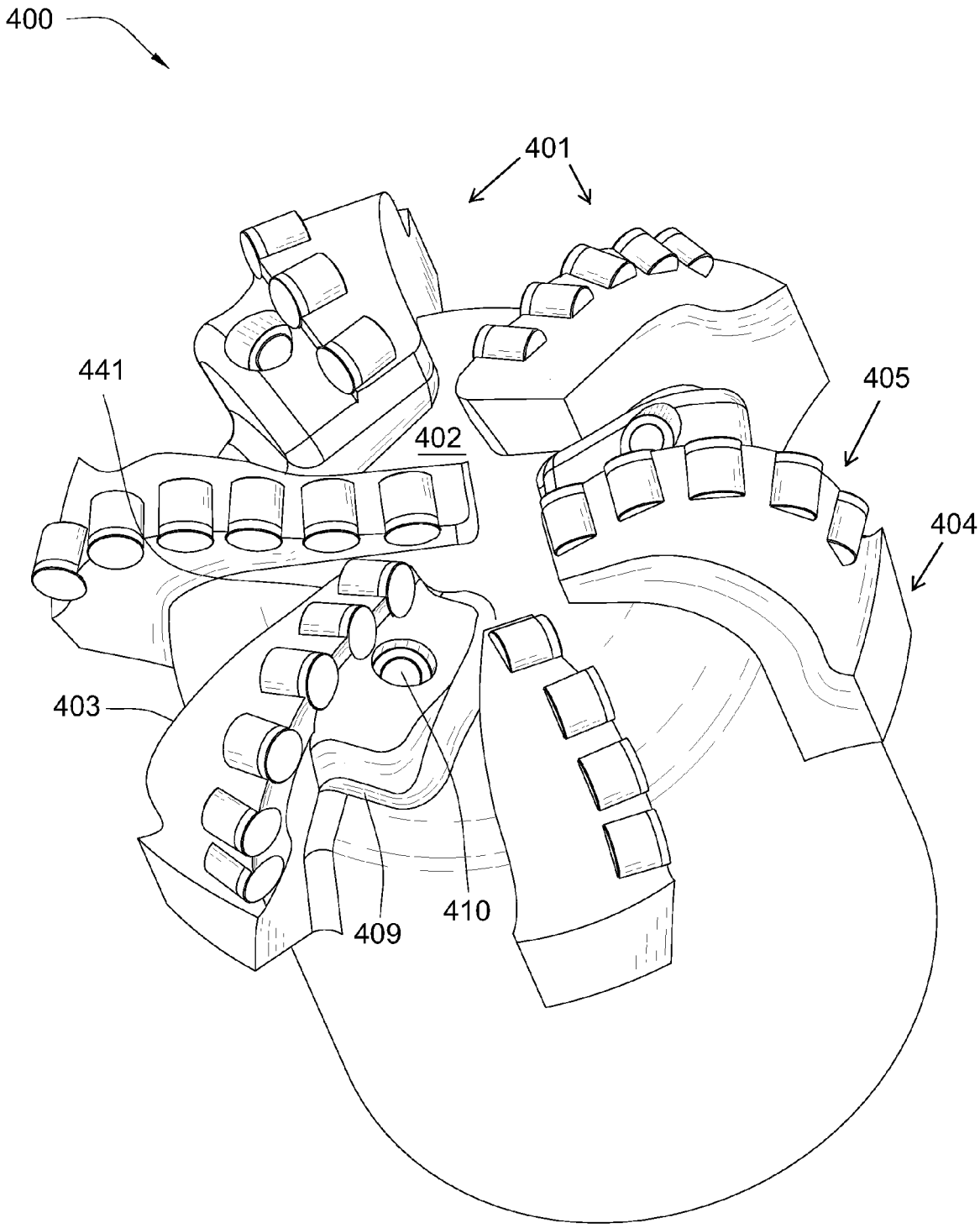
FIG. 6 is another perspective diagram of an embodiment of a drill bit.

FIG. 6 is another perspective diagram of a drill bit 400. The drill bit 400 may comprise a plurality of blades 401 disposed on the working face 402. Intermediate (between) the nose 403 region and the gauge 404 may be the flank 405. The elevated surface 409 immediately in front of the blades 401 may extend from the nose 403 region to the conical region 441 of the blade. The elevated surface 409 may also comprise a single nozzle 410 disposed in the elevated surface 409.

Figure 7:
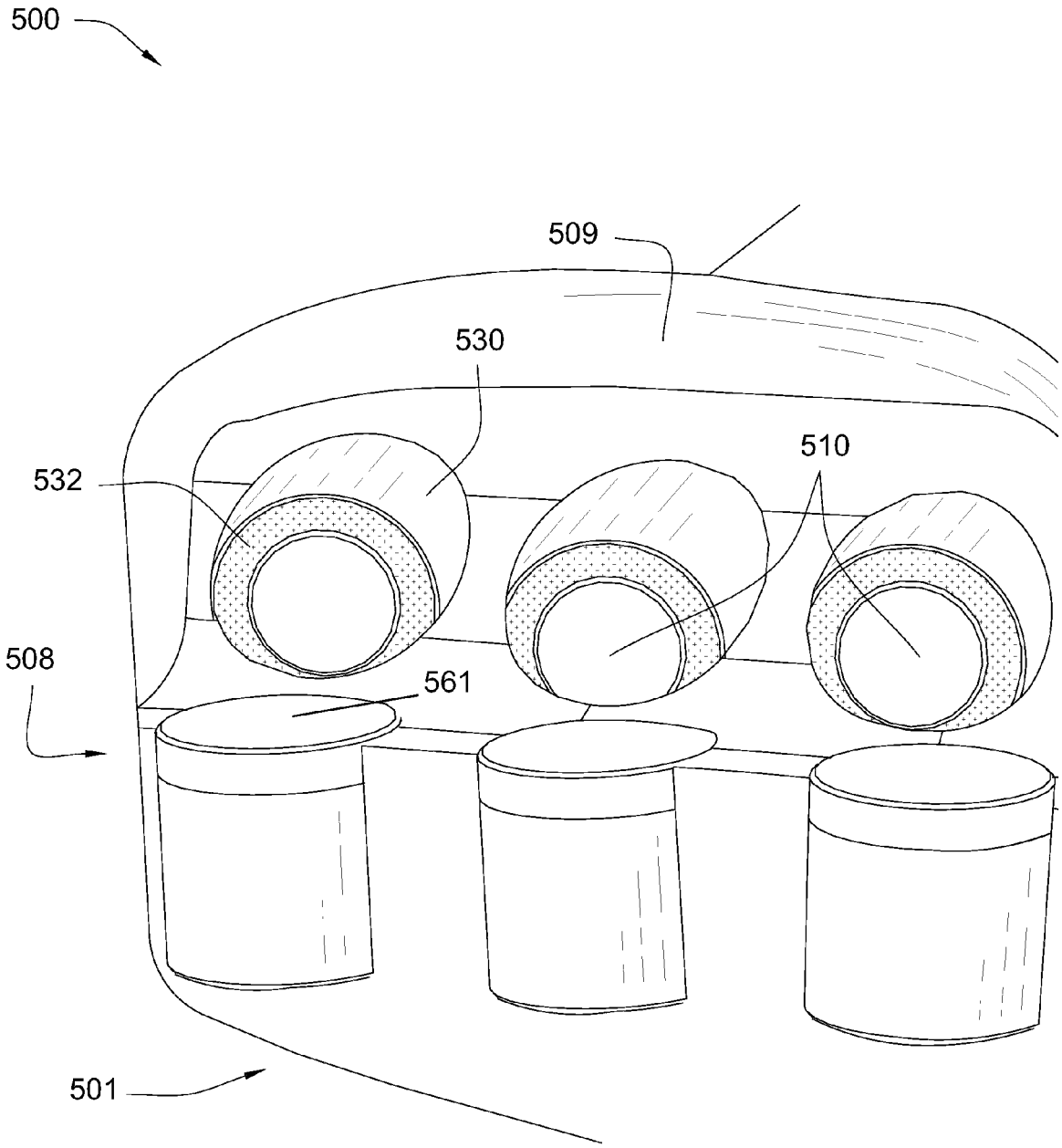
FIG. 7 is another perspective diagram of an embodiment of a drill bit.

FIG. 7 is another perspective diagram of a drill bit 500. FIG. 7 shows a close-up diagram of a plurality of nozzles 510, each being disposed within a nozzle bore 530 formed into the elevated surface 509. The elevated surface 509 may be immediately in front of the blade 501 that comprises a diamond working end 508 having a planar cutting surface 561. The elevated surface can comprise an additional cutting surface that is complimentary to the blade having the cutting surface comprising the diamond working end 508. The nozzle bore 530 within the elevated surface 509 may comprise hard facing 532. The at least one nozzle 510 within the elevated surface 509 may comprise a hard facing 732 that may aid in protecting the at least one nozzle 710 from wear. The at least one nozzle 710 may be angled such that the fluid (not shown) projected may not directly contact the diamond working end 508.

Figure 8:
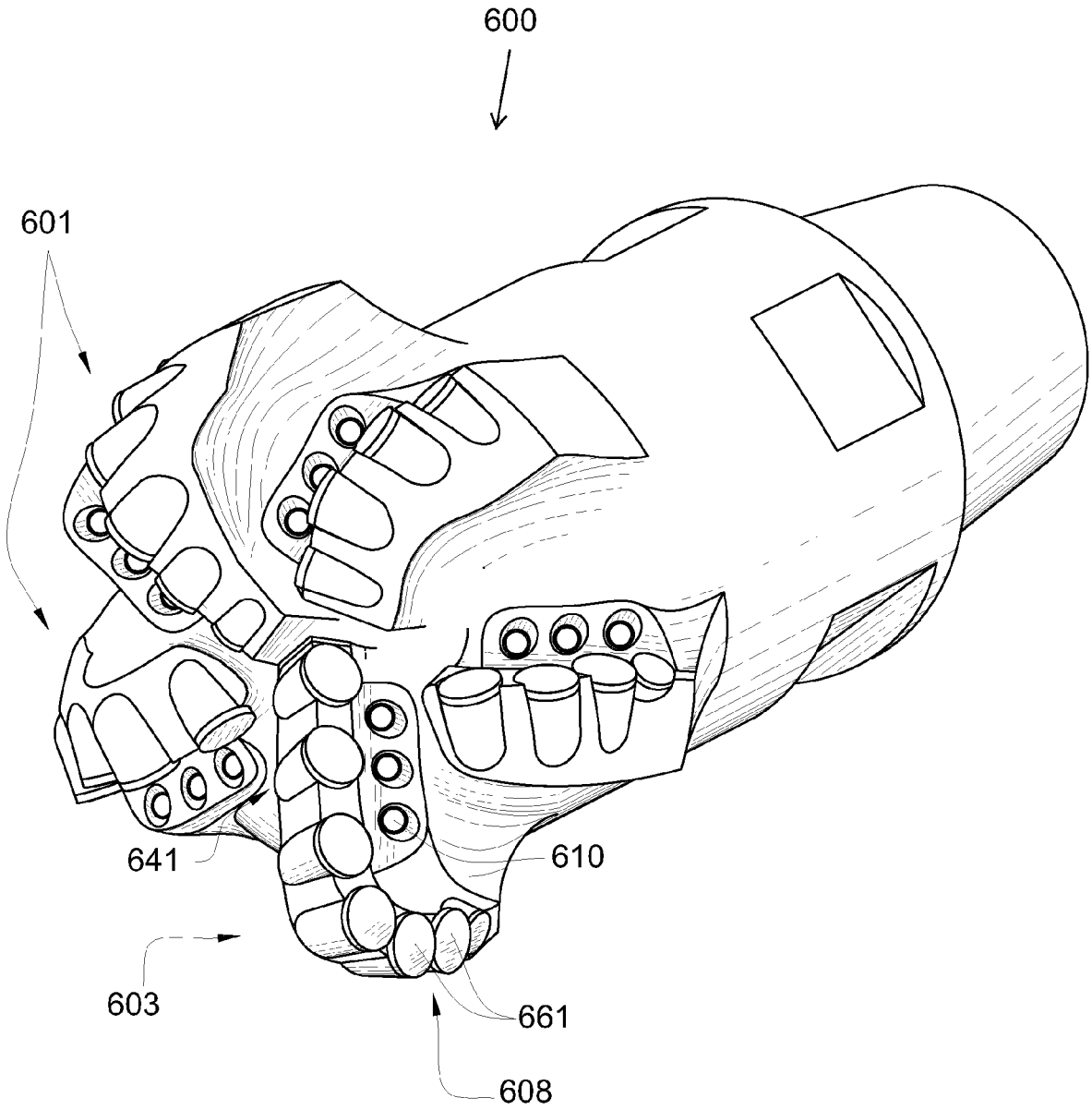
FIG. 8 is a perspective diagram of another embodiment of a drill bit.

FIG. 8 is a perspective diagram of drill bit 600. FIG. 8 shows a drill bit 600 comprising five blades 601. The blades 601 may comprise a diamond working end 608 with a planar cutting surface 661. Adjacent to the blades 601 may be elevated surfaces 609 that may comprise at least one nozzle 610. The elevated surface 610 may extend from the nose 603 region of the blade to the conical region 641 of the blade 601.

Figure 9:
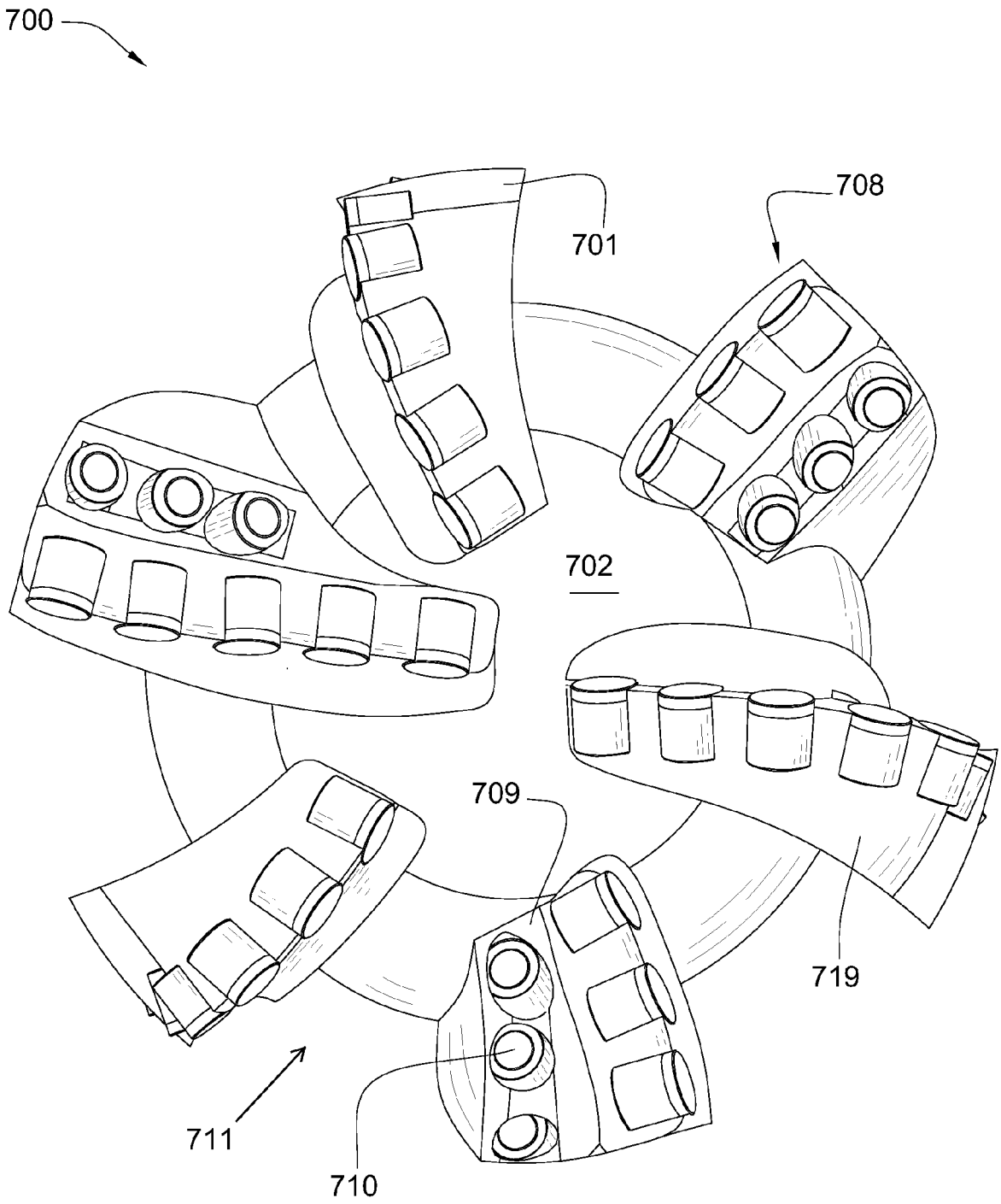
FIG. 9 is another perspective diagram of an embodiment of a drill bit.

FIG. 9 is another top perspective diagram of a drill bit 700. The drill bit 700 may comprise a plurality of elevated surfaces 709 intermediate a plurality of blades 701. The junk slots 711 may comprise the elevated surface 709 which may comprise one side that is contact with the side 719 of the blades 701 opposite the side comprising the diamond working end 708. The elevated surface 709 may be in front of but not immediately in front of the diamond working surface. The elevated surface 709 may comprise at least one nozzle 710 adapted to clear debris from the working face 702 of the drill bit 700.

Figure 10:
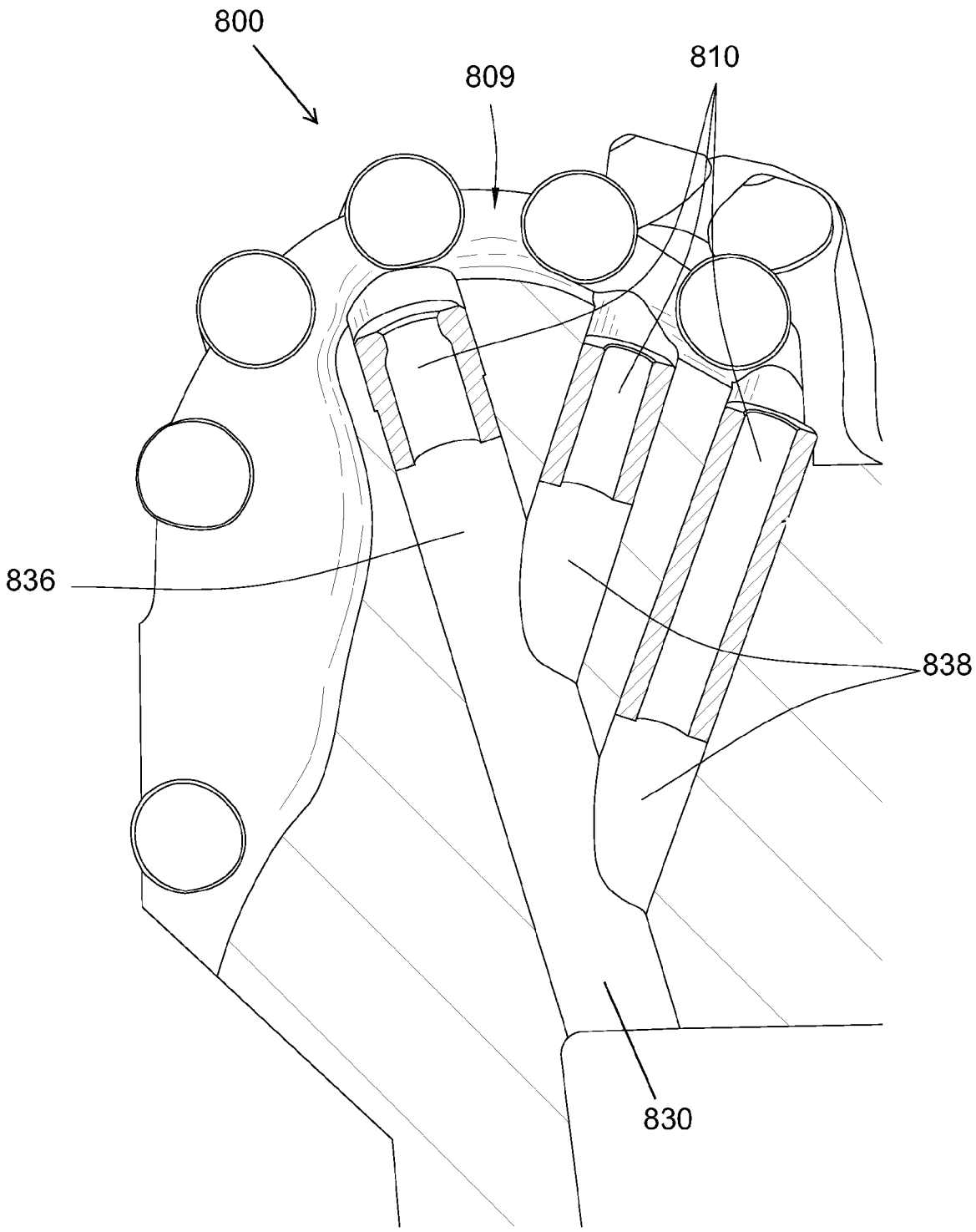
FIG. 10 is cross-sectional diagram of an embodiment of a drill bit.

FIG. 10 is a cross sectional diagram of another embodiment of a drill bit 800. Several nozzles 810 are disposed within nozzle bores 830 formed in the elevated surface 809 of the junk slot. The nozzles 810 can diamond. The nozzles 810 may be fixed nozzle which may be bonded or pressed into place within the nozzle bores 830, or they may be removable nozzle. In some embodiments, there may be a primary bore 836 and tributary bores 838 may be formed to intersect the primary bore 836.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:

a body intermediate a threaded shank and a working face;

the working face comprising a plurality of blades, each blade having at least one cutting surface with a carbide substrate bonded to a diamond working end;

a plurality of junk slots separating the plurality of blades, at least one of the junk slots comprising a base and an elevated surface formed between the base and the diamond working end of the cutting surface of one of the plurality of blades, and with the elevated surface extending from a nose region to a conical region of the blade; and at least one nozzle disposed within a nozzle bore formed into the elevated surface of the at least one junk slot.

2. The drill bit of claim 1, wherein the diamond working end is selected from the group consisting of a planar cutting surface and a pointed cutting surface.

3. The drill bit of claim 2, wherein the diamond working end having a pointed cutting surface is secured to the blade at a 25 to 65 positive rake angle.

4. The drill bit of claim 2, wherein at least one of the plurality of blades comprises diamond working ends with planar cutting surfaces and another of the plurality of blades comprises diamond working ends with pointed cutting surfaces.

5. The drill bit of claim 1, wherein the at least one nozzle comprises a diameter of 0.2125-0.4125 inches.

6. The drill bit of claim 1, wherein the at least one nozzle is positioned less then 1 inch beneath the elevated surface within the nozzle bore.

7. The drill bit of claim 1, wherein the at least one nozzle is angled such that fluid is directed toward the at least one cutting surface of the blade.

8. The drill bit of claim 1, wherein the at least one nozzle comprises diamond.

9. The drill bit of claim 1, wherein the junk slots comprise a plurality of elevated surfaces.

10. The drill bit of claim 1, wherein a base of one of the plurality of junk slots includes at least one base nozzle.

11. The drill bit of claim 10, wherein at least one base nozzle is disposed in front of a diamond working end with a pointed cutting surface.

12. The drill bit of claim 1, wherein the plurality of nozzles are disposed on different elevated levels within the elevated surface.

13. The drill bit of claim 1, wherein the elevated surface extends to the diamond working end.

14. The drill bit of claim 1, wherein the elevated surface comprises an additional cutting surface complementary to the blade comprising the at least one cutting surface.

15. The drill bit of claim 10, wherein a diameter of the at least one nozzle is smaller relative to a diameter of the base nozzle.

16. The drill bit of claim 1, wherein the elevated surface is a step formed in the blade.

17. The drill bit of claim 1, wherein the elevated surface in contact with a side of the blade opposite the side having at least one diamond working end.

18. The drill bit of claim 1, wherein the at least one nozzle is press-fit or brazed into a nozzle bore formed into the elevated surface.

19. A drill bit, comprising:

a bit body having a threaded shank and a working face spaced apart from said shank;

said working face including a plurality of alternating first and second blades, including:

at least one first blade having a planar diamond cutting surface bonded to a carbide substrate; and at least one second blade having a pointed diamond cutting surface bonded to a carbide substrate;

a plurality of junk slots separating said plurality of blades, including at least one first junk slot having a base surface and an elevated surface formed between said base surface and said planar diamond cutting surface of said first blade; and at least one nozzle disposed within a nozzle bore formed into said elevated surface of said first junk slot.

20. The drill bit of claim 19, further comprising at least one second junk slot having at least one base nozzle is disposed in front of said pointed diamond cutting surface of said second blade.

* * * * *